US007386137B2

(12) United States Patent
Combest

(10) Patent No.: US 7,386,137 B2
(45) Date of Patent: Jun. 10, 2008

(54) SOUND TRANSDUCER FOR SOLID SURFACES

(75) Inventor: Christopher Combest, Leawood, KS (US)

(73) Assignee: Multi Service Corporation, Overland Park, KS (US)

( * ) Notice: Subject to any disclaimer, the term of this patent is extended or adjusted under 35 U.S.C. 154(b) by 362 days.

(21) Appl. No.: 11/069,320

(22) Filed: Mar. 1, 2005

(65) Prior Publication Data

US 2006/0126886 A1 Jun. 15, 2006

Related U.S. Application Data

(63) Continuation-in-part of application No. 11/012,925, filed on Dec. 15, 2004.

(51) Int. Cl.
*H04R 25/00* (2006.01)

(52) U.S. Cl. ..... 381/182; 381/396; 381/401

(58) Field of Classification Search ..... 381/396, 381/400, 401, 403, 404, 405, 407, 412, 417, 381/418, 182, 186, 423; 310/81; 335/222, 335/252

See application file for complete search history.

(56) References Cited

U.S. PATENT DOCUMENTS 1,383,700 A 7/1921 Egerton
2,341,275 A 2/1944 Holland
3,328,524 A 6/1967 Bechtel et al.
3,430,007 A 2/1969 Thielen
3,449,531 A 6/1969 Ashworth
3,524,027 A 8/1970 Thurston et al.
3,567,870 A 3/1971 Rivera
3,664,911 A 5/1972 Takabayashi
3,666,749 A 5/1972 de Musquiz Reumert et al.
3,721,449 A 3/1973 Sirinek
3,731,006 A 5/1973 Streiffert et al.
3,761,956 A 9/1973 Takahashi et al.
3,776,090 A 12/1973 Ihara
3,839,601 A 10/1974 Kimura et al.
3,858,679 A 1/1975 Askins
3,861,495 A 1/1975 Pearson
3,999,845 A 12/1976 Brushenko
4,000,381 A * 12/1976 Plice et al. ..... 381/418
4,004,094 A 1/1977 Ott
4,158,400 A 6/1979 Vice
4,195,843 A 4/1980 Watanabe et al.
4,251,687 A 2/1981 Deutsch (Continued)

*Primary Examiner*—Huyen Le
(74) *Attorney, Agent, or Firm*—Hovey Williams LLP

(57) ABSTRACT

A sound transducer (10) for imparting acoustical energy directly to a solid surface (12) while achieving the sound quality and frequency response found only in conventional diaphragm speakers. The sound transducer (10) comprises a pair of symmetrical magnet assemblies (16, 18), a pair of symmetrical voice coils (66, 68), and an actuator (22). The magnet assemblies (16, 18) each present an area of concentrated magnetic flux (60, 62). The symmetrical voice coils (66, 68) are positioned in the vicinity of the areas of concentrated magnetic flux and are operable to receive an alternating audio signal which causes the voice coils to move relative to the magnet assemblies. The actuator (22) moves with the voice coils and includes a foot (70) for coupling with a solid surface to impart movement to the solid surface and thereby produce sound when the voice coils receive the audio signal. The actuator (22) is coupled to the voice coils (66, 68) by an elongated shaft (24). The shaft (24) is supported for linear movement by a pair of spaced-apart bearings (74, 76).

21 Claims, 2 Drawing Sheets

U.S. PATENT DOCUMENTS 4,370,912 A 2/1983 Glynn
4,373,199 A 2/1983 Watanabe
4,440,259 A 4/1984 Strohbeen
4,496,247 A 1/1985 Kumada
4,514,599 A 4/1985 Yanagishima et al.
4,580,654 A 4/1986 Hale
4,648,086 A 3/1987 Koike
4,648,478 A 3/1987 Dedole et al.
4,746,905 A 5/1988 Harima et al.
4,810,997 A 3/1989 Kudo et al.
4,944,019 A 7/1990 Watanabe
4,951,270 A 8/1990 Andrews
4,966,164 A 10/1990 Colsen et al.
5,307,418 A 4/1994 Sumitani
5,317,305 A 5/1994 Campman
5,517,570 A 5/1996 Taylor
5,539,835 A 7/1996 Bertagni et al.
5,570,322 A 10/1996 Miller
5,590,207 A 12/1996 Taylor
5,590,771 A 1/1997 Cota
5,611,721 A 3/1997 Hoeting et al.
5,689,570 A 11/1997 Taylor
5,701,358 A 12/1997 Larsen et al.
5,706,254 A 1/1998 Stahl
5,734,728 A 3/1998 Meissner
5,738,560 A 4/1998 Bears
5,760,319 A 6/1998 Dickinson
5,812,675 A 9/1998 Taylor
5,812,685 A 9/1998 Fujita et al.
5,967,686 A 10/1999 Melnick
6,009,182 A 12/1999 Gunness
6,031,919 A 2/2000 Funahashi et al.
6,072,111 A 6/2000 Senn
6,108,432 A 8/2000 Watanabe
6,144,306 A 11/2000 Huang
6,188,313 B1 2/2001 Stahl
6,227,927 B1 5/2001 Smith
6,229,899 B1 5/2001 Norris et al.
6,257,949 B1 7/2001 Vickers
6,320,971 B1 11/2001 Tozawa
6,335,974 B1 1/2002 Kunimoto
6,389,144 B1 5/2002 Lee
6,441,293 B1 8/2002 LaBarbera
6,487,296 B1 11/2002 Allen et al.
6,489,545 B1 12/2002 Hart et al.
6,520,282 B1 2/2003 Hadzic et al.
6,563,254 B2 5/2003 Perkins et al.
6,611,605 B2 8/2003 Kim
6,618,487 B1 9/2003 Azima et al.
6,751,329 B2 6/2004 Colloms et al.
6,751,333 B1 6/2004 Azima et al.
6,778,677 B2 * 8/2004 Coffin ..... 381/418
7,149,323 B2 * 12/2006 Yamagishi ..... 381/415
2003/0053375 A1 3/2003 Watanabe et al.
2003/0188629 A1 10/2003 Suenaga
2003/0222785 A1 12/2003 Weinstein

* cited by examiner

SOUND TRANSDUCER FOR SOLID SURFACES

RELATED APPLICATIONS

The present application is a continuation-in-part and claims priority benefit, with regard to all common subject matter, of an earlier-filed U.S. patent application titled "SOUND TRANSDUCER FOR SOLID SURFACES," Ser. No. 11/012,925, filed Dec. 15, 2004. The above-identified non-provisional application is hereby incorporated by reference into the present application.

BACKGROUND OF THE INVENTION

1. Field of the Invention

The present invention relates to audio systems and speakers. More particularly, the invention relates to an improved sound transducer for imparting acoustical energy directly to a solid surface such as a wall or pane of glass.

2. Description of the Prior Art

High performance audio systems and speakers continue to grow in popularity as more and more consumers install home theater systems in their homes, offices and other personal spaces. Such home theater systems typically consist of a high definition TV, projection TV, plasma screen, or other monitor; one or more video sources such as a DVD player or a VCR; a surround-sound receiver; and a plurality of speakers coupled with and driven by the surround-sound receiver.

High performance surround-sound receivers typically have five or seven separate audio channels for driving five or more speakers. The speakers are strategically positioned around a listening area to accurately produce the audio portion of a movie or other program. A pair of speakers may, for example, be positioned behind a typical listening area, another pair of speakers may be positioned in front of the listening area, and another pair of speakers may be positioned to the sides of the listening area.

Speakers convert electrical energy representative of music or other sounds to acoustical energy. Conventional speakers include a voice coil which moves relative to a permanent magnet when it receives an alternating audio signal. The voice coil then vibrates a paper diaphragm or cone to provide sound waves. The cone moves because of a dynamic interaction between two magnet fields, one coming from the permanent magnet and the other created by the signal voltage applied to the voice coil. The permanent magnet's field does not change direction; it remains highly concentrated and constant near the voice coil. An alternating audio signal applied to the voice coil creates an alternating magnetic field emanating from the voice coil. The alternating magnetic field of the voice coil interacts with the stationary magnetic field of the permanent magnet to move the voice coil. Specifically, the voice coil and the attached cone move forward and backward in accordance with the varying polarity of the signal applied to the voice coil. The oscillations of the diaphragm closely follow the variations in the applied electrical signal to set up sound waves.

Because conventional speakers rely upon the movement of a diaphragm or cone, they must be mounted so that the diaphragm is at least partially exposed to the listening area in which the sound is directed. Mounting numerous speakers in a listening area without interfering with windows, doors, columns, and other structural components of a room can be challenging. One way to overcome this challenge is to hang some or all of the speakers from the room's ceiling with swiveling brackets so they may be oriented to project sound in desired directions. However, some people find this mounting arrangement unsightly, especially when numerous speakers of varying sizes must be hung from the ceiling. Another installation method flush mounts the speakers in walls, ceilings and other surfaces so that the speakers do not project as far into a room. However, this method is considered unattractive by some people as well, because the speakers and their associated grills take up valuable wall and ceiling space and remain visible, thus detracting from the appearance of the room.

Magnetostrictive speakers, such as the SolidDrive™ speakers sold by Induction Dynamics® have been developed to alleviate some of the problems associated with speaker installation. Such speakers convert audio signals to powerful vibrations that can be transferred into solid surfaces such as walls, ceilings, windows, tables, office desks, etc., thus delivering sound from the entire surfaces. This permits the speakers to be positioned entirely behind these surfaces and therefore completely hidden from view. For example, such speakers are often mounted behind walls so that there are absolutely no visible speakers or wires. Although magnetostrictive speakers can be hidden and therefore solve many of the installation problems discussed above, they do not reproduce sound as accurately as conventional speakers and often exhibit non-uniform and less predictable frequency responses.

Sound transducers which use conventional voice coil technology to impart acoustical energy to solid surfaces have also been developed. However, these prior art sound transducers are generally not powerful enough to move a rigid wall or other solid surface sufficiently to create a desirable level and quality of sound. Moreover, such prior art transducers do not produce a uniform frequency response due to their construction.

SUMMARY OF THE INVENTION

The present invention solves the above-described problems and provides a distinct advance in the art of audio systems and speakers used in home theater systems and other high performance audio applications. More particularly, the present invention provides a sound transducer for imparting acoustical energy directly to a solid surface while achieving the sound quality and frequency response found only in conventional diaphragm speakers.

One embodiment of the sound transducer comprises a pair of symmetrical magnet assemblies, a pair of symmetrical voice coils, and an actuator. The magnet assemblies each present an area of concentrated magnetic flux. The symmetrical voice coils are positioned in the vicinity of the areas of concentrated magnetic flux and are operable to receive an alternating audio signal which causes the voice coils to move relative to the magnet assemblies. The actuator moves with the voice coils and includes a foot for coupling with a solid surface to impart movement to the solid surface and thereby produce sound when the voice coils receive the audio signal.

The symmetrical magnet assemblies and voice coils drive the actuator with more power than prior art sound transducers and therefore reproduce more sound. Moreover, the symmetrical design provides a more consistent and uniform frequency response. The actuator foot is larger than actuators of prior art sound transducers and therefore transfers more acoustical energy without damaging the solid surface to further enhance the sound production and frequency response of the sound transducer.

The sound transducer may also include a pair of symmetrical suspension springs. The springs are stiffer than conventional accordion-edge suspensions and therefore better align the voice coils in the area of concentrated magnetic flux of the magnet assemblies. This creates more uniform and consistent movement of the voice coil and actuator and therefore more uniform and consistent sound reproduction and frequency response. Use of a pair of symmetrical suspension springs further improves the alignment of the voice coils.

The sound transducer also preferably includes an elongated shaft for coupling the actuator to the voice coils. Opposite ends of the elongated shaft are supported for linear movement by a pair of bearing tubes. The use of two spaced-apart bearing tubes stabilizes the shaft and attached voice coils, keeps the voice coils properly aligned in the magnetic flux of the magnet assemblies and prevents the voice coils from wobbling or other undesired movements that creates sound distortion. The spaced-apart bearing tubes also divide and balance the weight of the magnet assemblies and corresponding housing to reduce the amount of torque on the shaft and attached actuator and maintain the alignment of the shaft and voice coils regardless of the mounting configuration of the sound transducer. For example, if the actuator is mounted to a vertical wall, the shaft extends horizontally from the wall. The spaced-apart bearing tubes reduce the torque on the shaft and maintain the alignment of the shaft and voice coils against the force applied by the heavy magnet assemblies.

These and other important aspects of the present invention are described more fully in the detailed description below.

BRIEF DESCRIPTION OF THE DRAWING FIGURES

Preferred embodiments of the present invention are described in detail below with reference to the attached drawing figures, wherein.

Figure 2:
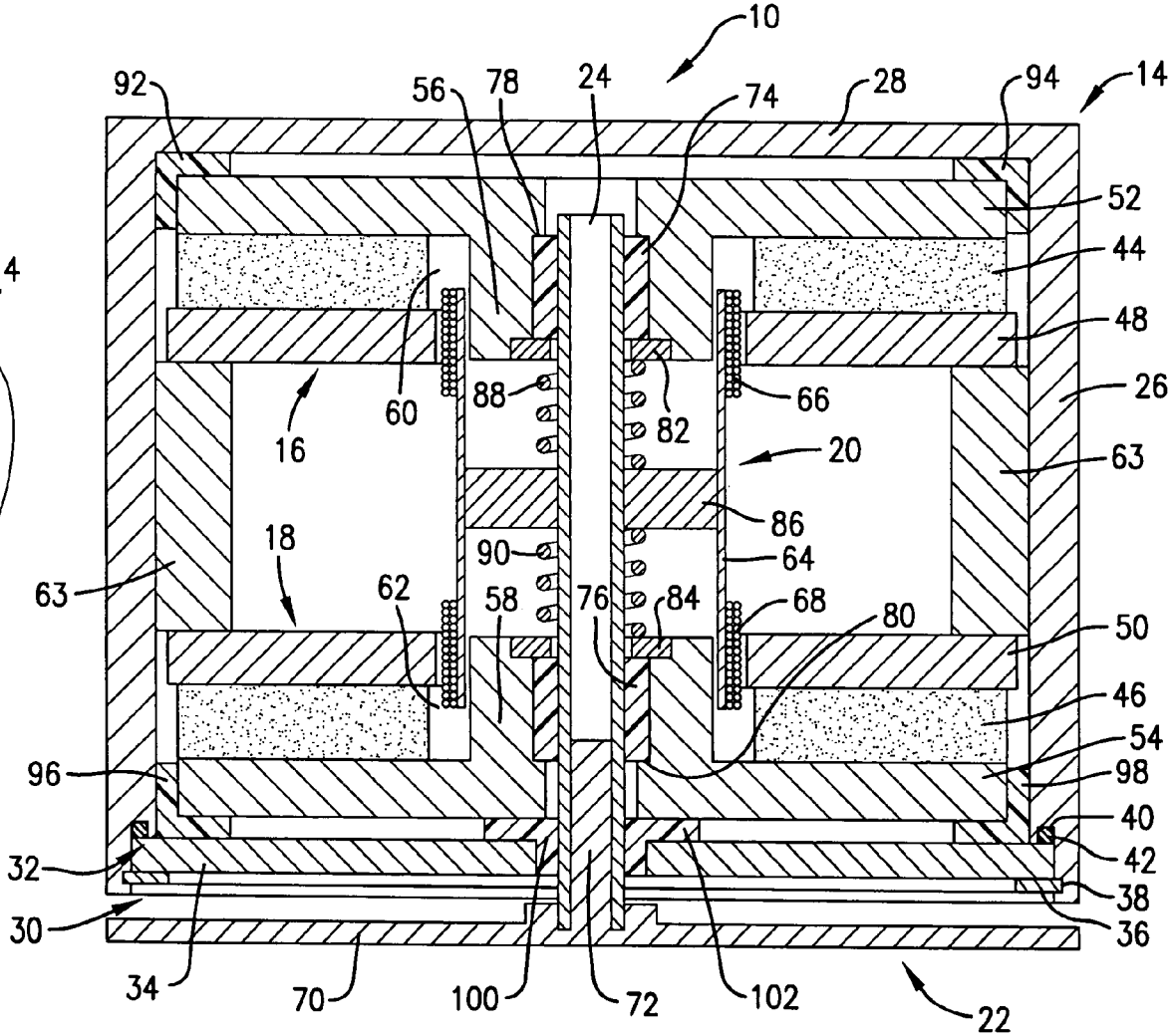
FIG. 2 is a vertical sectional view of the sound transducer shown in FIG. 1.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

Figure 1:
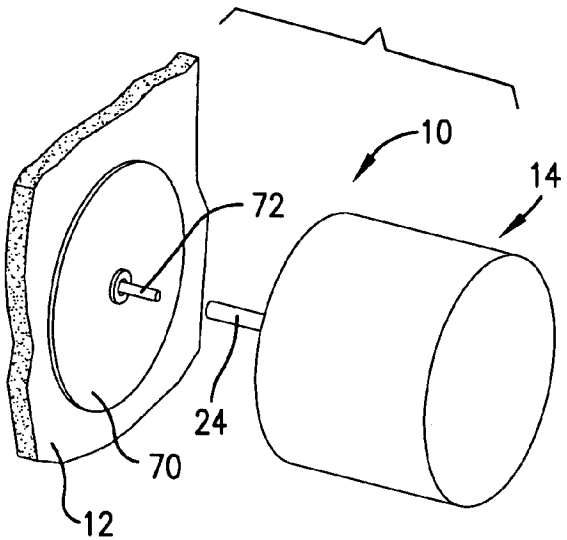
FIG. 1 is a perspective view of a sound transducer constructed in accordance with an embodiment of the present invention and shown coupled with a wall or other solid surface.

A sound transducer 10 constructed in accordance with a preferred embodiment of the present invention is shown in FIG. 1 attached to a solid surface 12 such as a wall of a room or other listening area. As explained in more detail below, the sound transducer 10 imparts acoustical energy directly to the solid surface 12 to vibrate the solid surface 12 in accordance with an applied audio signal to thereby produce sound.

The solid surface 12 may be constructed of any material or combination of materials such as drywall, glass, fiberglass, wood, or even metal; however, extremely thick materials such as concrete are not preferred because they do not transfer acoustical energy well enough to produce much usable sound. The sound transducer 10 is preferably mounted to an area of the solid surface 12 that is not directly attached to another more rigid surface. For example, when attached to a wall consisting of drywall supported by wooden studs, the sound transducer 10 is preferably attached near the mid-point of two adjacent studs so that the portion of drywall to which the sound transducer is attached moves more freely.

One embodiment of the sound transducer 10 is shown in FIG. 2 and broadly includes an outer housing 14; a pair of symmetrical magnet assemblies 16, 18; a voice coil assembly 20; an actuator 22; and a shaft 24 for coupling the actuator 22 to the voice coil assembly 20. Each of these components is described in detail below.

The outer housing 14 is preferably a hollow cylinder presenting a side wall 26, an end wall 28 enclosing one end of the side wall and an open end 30. The housing 14 is preferably made of a heavy, non-magnetic material such as zinc and in one embodiment has a side wall thickness of approximately 3/16 inch, a height of approximately two inches, and a diameter of approximately two inches. The particular dimensions of the housing, however, can be varied as a matter of design choice and are provided only for purposes of disclosing a best mode of the invention.

A section of the side wall 26 adjacent the open end 30 has a reduced thickness to form a shelf 32 for receiving and supporting a circular cover plate 34 for removably closing the open end 30. The cover plate 34 is also preferably formed of a heavy, non-magnetic material such as zinc and has a central bore or hole through which one end of the shaft 24 extends. The cover plate 34 is held in place by a snap-ring 36 positioned in an annular groove 38 adjacent the outer end 30 of the side wall 26. Another groove 40 is formed in the shelf 32 for receiving an O-ring 42 or other type of seal.

The magnet assemblies 16, 18 are positioned within opposite ends of the housing 14 and are substantially identical and therefore symmetrical. As described in more detail below, use of two symmetrical magnet assemblies 16, 18 increases the power of the sound transducer 10 and provides a more uniform frequency response.

Each of the magnet assemblies 16, 18 includes a permanent magnet 44, 46 sandwiched between a top plate 48, 50 and a bottom plate 52, 54. The permanent magnets 44, 46 are preferably ring-shaped so as to present a central opening or bore. The permanent magnets 44, 46 are preferably formed of Neodymium material, and in one embodiment, are capable of producing a flux density between 8,000 and 14,000 Gauss and more specifically between 10,000 and 12,000 Gauss.

The top plates 48, 50 and the bottom plates 52, 54 cover the top and bottom faces of the permanent magnets 44, 46 to concentrate the magnetic flux of the permanent magnets. The top and bottom plates are also preferably ring-shaped so as to present a central opening or bore aligned with the bore of the permanent magnets and are preferably formed of a magnetic material such as iron or carbon steel. A ring-shaped magnetic pole piece 56, 58 is integrally formed with or attached to each of the bottom plates 52, 54 to further concentrate the magnetic flux of the permanent magnets 44, 46. The magnetic pole pieces 56, 58 are preferably formed of low-carbon steel material.

An area of concentrated magnetic flux 60, 62 is defined by the inner wall of each permanent magnet 44, 46, the inner wall of each top plate 48, 50, and the outer wall of each magnetic pole piece 56, 58. This area of concentrated magnetic flux 60, 62 receives the voice coils as described below.

The housing 14, magnet assemblies 16, 18, and the other enclosed components must be sufficiently heavy to provide inertia for the actuator to work against because the housing is preferably only supported through the actuator foot. If the housing 14 and the enclosed components were too light, the actuator would simply vibrate the housing rather than the solid surface. In one embodiment, the housing and the components contained therein weigh approximately 1-2 pounds and preferably approximately 1.75 pounds. To further increase the weight of the housing and enclosed components, a ring-shaped ballast 63 may be positioned between the two magnet assemblies 16, 18.

The voice coil assembly 20 includes a voice coil former 64 and two symmetrical voice coils 66, 68 wound on opposite ends of the voice coil former 64. The voice coil former 64 is preferably a hollow cylinder formed of aluminum. The voice coils 66, 68 are preferably insulated with a high-temperature coating.

The voice coil former 64 extends between the two magnet assemblies 16, 18 and within the central bores of the top plates and permanent magnets to position the voice coils 66, 68 within the areas of concentrated magnetic flux 60, 62. As explained in more detail below, the voice coil assembly 20 moves relative to the magnet assemblies 16, 18 in a direction parallel to an axis extending through the central bores of the permanent magnets 44, 46.

Each of the voice coils 66, 68 consists of a length of wire or other electrically conductive material wound on opposite ends of the voice coil former 64 and electrically coupled to one or more input terminals. The input terminals are in turn connected to a source of audio signals such as those provided by a stereo radio receiver. Both voice coils 66, 68 include the same amount of wire and are connected to the same audio source so as to be symmetrical. Thus, the voice coils 66, 68 assist each other in moving the voice coil former 64 and the attached actuator 22.

The actuator 22 includes an enlarged foot 70 that extends from the open end 30 of the housing 14 and a stud or pin 72 which extends into the housing through the central opening in the cover plate 34. The foot 70 is glued or otherwise attached to the solid surface 12 as illustrated in FIG. 1 to transfer acoustical energy to the solid surface as explained in more detail below. The foot 70 presents a large surface area for two primary purposes: 1) to transfer a maximum amount of acoustical energy to the solid surface 12 without damaging the surface; and 2) to provide enough area for a sufficient amount of glue or other adhesive to suspend the sound transducer 10 from the solid surface 12. The particular shape, size, and surface area of the foot can vary depending on the size and strength of the magnet assemblies 16, 18 and the voice coil assembly 20 as well as the weight of the housing 14 and enclosed components. The illustrated foot 70 has a diameter of two inches, which is approximately equal to the diameter of the housing 14. Thus, this embodiment of the foot presents a surface area slightly greater than three square inches.

The actuator stud 72 extends from one side of the foot 70 and indirectly couples the foot to the voice coil assembly 20 through the shaft 24. The actuator stud may be glued in the shaft, threaded into the shaft, or held in place by other conventional means.

The elongated shaft 24 may be partially hollow and is preferably formed of strong, non-oxidizing material such as stainless steel. The shaft 24 extends through the opening in the cover plate 34 and is positioned inside the central bores of the magnet assemblies 16, 18. The shaft 24 can move in a direction along an axis extending through the center of the housing and is supported against movement in other directions by a pair of bearing tubes 74, 76 each positioned inside of one of the pole pieces. The bearing tubes are preferably formed of Teflon or other material exhibiting low friction. The bearing tubes 74, 76 are each held in place on one end by a shelf or ridge 78, 80 formed between the bottom plates 52, 54 and the pole pieces 56, 58 and on the other end by a non-magnetic washer 82, 84.

The use of two spaced-apart bearing tubes 74, 76 stabilizes the shaft 24 and attached voice coils 66, 68 keeps the voice coils properly aligned in the magnetic flux of the magnet assemblies, and prevents the voice coils from wobbling or exhibiting other undesired movements that creates sound distortions. The spaced-apart bearing tubes 74, 76 also divide and balance the weight of the magnet assemblies 16, 18 and the housing 14 to reduce the amount of torque on the shaft 24 and the actuator 22 and maintain the alignment of the shaft and voice coils regardless of the mounting configuration (e.g., wall or ceiling mounted) of the sound transducer. This allows the shaft to move more freely and reduces the tendency of the actuator to pull away from surface to which it is attached.

The elongated shaft 24 is preferably at least 1" long and is preferably between 1" and 6" long. In one embodiment, the shaft is preferably between 2" and 4" in length.

The bearing tubes 74, 76 are spaced at least ½" apart along the length of the shaft 24 and are preferably spaced between ½" and 5" apart. In one embodiment, the bearing tubes 74, 76 are preferably spaced between ½" and 3" apart.

The voice coil assembly 20 is attached to the shaft 24 by a ring-shaped coupler 86 that extends between the outer wall of the shaft 24 and the inner wall of the voice coil former 64. The coupler 86 is preferably formed of aluminum or other heat conductive material so as to transfer heat generated by the voice coils 66, 68 away from the voice coil former 64 and to the shaft 24 and ambient air in the center of the housing.

A pair of symmetrical suspension springs 88, 90 suspend the voice coils 66, 68 in the areas of concentrated magnetic flux 60, 62 when no audio signal is applied to the voice coils and resist movement of the voice coils relative to the magnet assemblies 16, 18 when an audio signal is applied to the voice coils. The springs are stiffer than conventional accordion-edge suspensions and therefore better align the voice coils in the area of concentrated magnetic flux of the magnet assemblies. This creates more uniform and consistent movement of the voice coil and actuator and therefore more uniform and consistent sound reproduction and frequency response. Use of a pair of symmetrical suspension springs further improves the alignment of the voice coils.

Each suspension spring 88, 90 is supported between the voice coil coupler 86 and one of the washers 82, 84. When the various components of the sound transducer are positioned within the housing 14 and the cover plate 34 is attached to the open end 30 of the housing, the suspension springs 88, 90 are slightly compressed so as to securely hold in place the magnet assemblies 16, 18 while permitting the voice coil assembly 20, the shaft 24, the voice coil coupler 86, and the actuator 22 to move against the applied force of the springs 88, 90. A number of non-magnetic spacers 92, 94, 96, 98, 100, 102 may also be positioned within the housing 14 as shown to isolate the magnet assemblies 16, 18 from the housing and to firmly support them within the housing. The spacers are not required, however, as the magnet assemblies 16, 18 may be formed so as to tightly fit within the housing.

In operation, the actuator foot 70 is glued or otherwise attached to a solid surface 12 as shown in FIG. 1 so that the housing 14 and all its contained components are suspended from the solid surface 12. The permanent magnets 44, 46 of the magnet assemblies 16, 18 magnetize the top plates 48, 50, the bottom plates 52, 54, and the pole pieces 56, 58 to produce a constant magnetic field which is concentrated in the areas 60, 62. When an audio signal is applied to the voice coils 66, 68, an alternating magnetic field emanates from the voice coils to interact with the fixed magnetic field in the areas of concentrated magnetic flux 60, 62. This causes the voice coil assembly 20 to move or vibrate in accordance with the applied audio signal. The movement of the voice coil assembly 20 is transferred through the voice coupler 86 and to the shaft 24, which in turn transfers the acoustical energy to the solid surface 12 through the actuator foot 70.

Because two symmetrical magnet assemblies 16, 18 and voice coils 66, 68 are used, the sound transducer 10 generates considerably more power than prior art sound transducers. This force is then transferred to the solid surface 12 by the large surface areas of the actuator foot 70. The symmetrical suspension springs 66, 68 resist the movement of the voice coil assembly 20 and bias it back to its rest state shown in FIG. 2 to provide a uniform frequency response.

Figure 3:
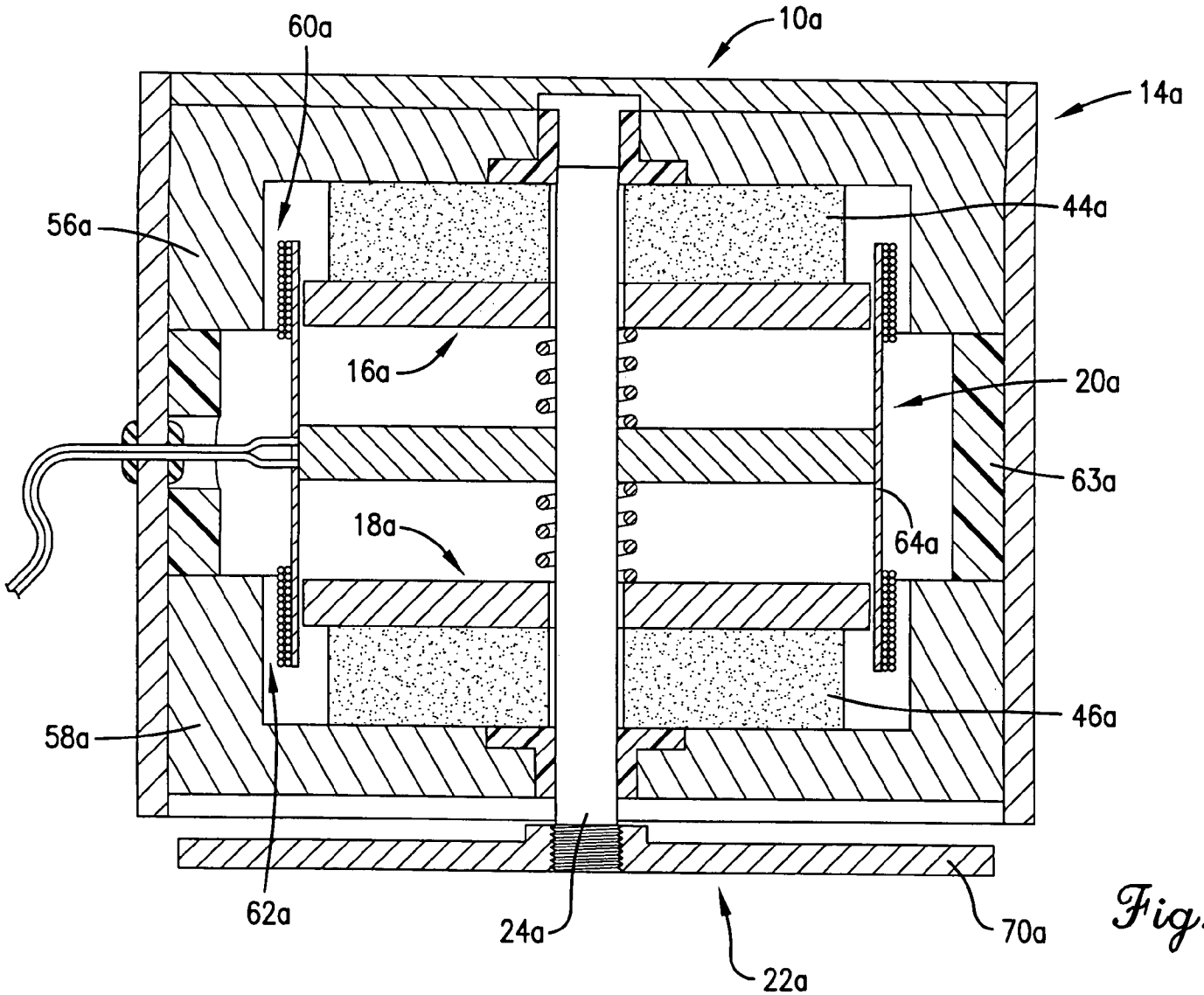
FIG. 3 is a vertical sectional view of a sound transducer constructed in accordance with another embodiment of the invention.

Another embodiment of a sound transducer 10*a* is shown in FIG. 3. The sound transducer 10*a* of this embodiment also includes an outer housing 14*a;* a pair of symmetrical magnet assemblies 16*a,* 18*a;* a voice coil assembly 20*a;* and an actuator 22*a.* These components are substantially similar to the components described above in connection with the embodiment illustrated in FIG. 2 except for the following differences.

The magnet assemblies 16*a,* 18*a* are configured so as to present an area of concentrated magnetic flux 60*a,* 62*a* that is between the outer wall of the permanent magnets 44*a,* 46*a* and the inner wall of the pole pieces 56*a,* 58*a,* rather than between the inner wall of the permanent magnets and the outer wall of the pole pieces as with the FIG. 2 embodiment. Also, the voice coil former 64*a* of the embodiment of FIG. 3 has a greater diameter so that it is spaced from the outer periphery of the permanent magnets rather than within the central bore of the permanent magnets with the FIG. 2 embodiment. By placing the permanent magnets 44*a,* 46*a* inside the voice coil former 64*a* and the pole pieces 56*a,* 58*a* outside the voice coil former 64*a,* the voice coil may be larger in diameter, enabling it to handle more power. The sound transducer 10*a* also includes a solid shaft 24*a* that is directly threaded into or otherwise coupled with the actuator foot 70*a* so that a separate actuator stud or pin is not needed. Operation of the sound transducer 10*a* shown in FIG. 3 is otherwise the same as the operation of the sound transducer shown in FIG. 2.

The embodiment of FIG. 3 also presents more open space inside the voice coil in which weights, in addition to the ballast 63*a,* may be placed to further increase the overall weight of the housing and enclosed components. For example, weights may be glued or otherwise attached to the top plates of the magnet assemblies.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A sound transducer comprising:

a pair of symmetrical magnet assemblies, each presenting an area of concentrated magnetic flux;

a pair of symmetrical voice coils, each positioned in the vicinity of one of the areas of concentrated magnetic flux, and operable to receive an alternating audio signal which causes the voice coils to move relative to the magnet assemblies;

an actuator that moves with the voice coils and that includes a foot for coupling with a solid surface to impart movement to the solid surface and thereby produce sound when the voice coils receive the audio signal;

a movable elongated shaft coupled to the actuator; and a pair of bearings, each positioned near an opposing end of the shaft, operable to maintain movement along the axis of the shaft.

2. The sound transducer as set forth in claim 1, wherein the voice coils are both wound on opposite ends of a cylindrical voice coil former which extends between the pair of magnet assemblies.

3. The sound transducer as set forth in claim 2, further including a pair of suspension springs operatively coupled with the voice coils for suspending the voice coils in the areas of concentrated magnetic flux and for resisting movement of the voice coils when the voice coils receive the audio signal.

4. The sound transducer as set forth in claim 3, wherein the shaft is coupled between the actuator and the voice coil former.

5. The sound transducer as set forth in claim 4, wherein the suspension springs surround the elongated shaft.

6. The sound transducer as set forth in claim 1, wherein each of the magnet assemblies includes a permanent magnet sandwiched between a magnetic top plate and a magnetic bottom plate.

7. The sound transducer as set forth in claim 6, wherein each of the magnet assemblies further includes a magnetic pole piece spaced from the permanent magnet to define the area of concentrated magnetic flux.

8. The sound transducer as set forth in claim 1, wherein the foot of the actuator has a large surface area coupled with the solid surface.

9. The sound transducer as set forth in claim 8, wherein the surface area of the foot is greater than one square inch.

10. The sound transducer as set forth in claim 9, wherein the surface area of the foot is approximately three square inches.

11. The sound transducer as set forth in claim 1, further including a cylindrical housing for housing the magnet assemblies and the voice coils.

12. The sound transducer as set forth in claim 11, wherein the foot has a diameter approximately equal to the diameter of the cylindrical housing.

13. A sound transducer comprising:

a pair of symmetrical magnet assemblies each presenting an area of concentrated magnetic flux and a central bore;

a voice coil assembly including:

an elongated cylindrical voice coil former having opposite ends each positioned in one of the areas of concentrated magnetic flux;

a pair of symmetrical voice coils, each wound on one of the opposite ends of the voice coil former, and each operable to receive an alternating audio signal which causes the voice coil assembly to move relative to the magnet assemblies;

an elongated shaft coupled with the voice coil former and positioned within the central bores of the magnet assemblies;

a pair of suspension springs operatively coupled with the voice coil former for suspending the voice coils in the areas of concentrated magnetic flux and for resisting movement of the voice coil assembly and the shaft when the voice coils receive the audio signal;

an actuator coupled with the shaft so that the actuator moves with the shaft and the voice coil assembly, the actuator including a foot for coupling with a solid surface to impart acoustical energy to the solid surface and thereby produce sound when the voice coils receive the audio signal; and a pair of bearings, each positioned near an opposing end of the shaft, operable to maintain motion along the axis of the shaft.

14. The sound transducer as set forth in claim 13, wherein each of the magnet assemblies includes a permanent magnet sandwiched between a magnetic top plate and a magnetic bottom plate.

15. The sound transducer as set forth in claim 14, wherein each of the magnet assemblies further includes a magnetic pole piece spaced from the permanent magnet to define the area of concentrated magnetic flux.

16. The sound transducer as set forth in claim 13, wherein the foot of the actuator has a large surface area coupled with the solid surface.

17. The sound transducer as set forth in claim 16, wherein the surface area of the foot is greater than two square inches.

18. The sound transducer as set forth in claim 13, further including a cylindrical housing for housing the magnet assemblies and the voice coils.

19. The sound transducer as set forth in claim 18, wherein the foot has a diameter approximately equal to the diameter of the cylindrical housing.

20. The sound transducer as set forth in claim 18, wherein the housing includes a removable cover plate.

21. A sound transducer comprising:

a pair of symmetrical magnet assemblies, each presenting an area of concentrated magnetic flux;

a pair of symmetrical voice cods, each positioned in the vicinity of one of the areas of concentrated magnetic flux, and operable to receive an alternating audio signal which causes the voice coils to move relative to the magnet assemblies:

a movable elongated shaft coupled to the voice coils:

a pair of bearings, each positioned near an opposing end of the shaft, operable to reduce friction on the shaft; and a foot coupled to the shaft for attachment to a solid surface, the solid surface selected from the group consisting of walls, ceilings, windows, tables, and desks, to impart movement to the solid surface and thereby produce sound when the voice coils receive the audio signal.

* * * * *